US010474095B2

(12) United States Patent
Katsumata

(10) Patent No.: US 10,474,095 B2
(45) Date of Patent: Nov. 12, 2019

(54) CARTRIDGE UNIT HAVING A PLURALITY OF SUPPORTING PORTIONS FOR SUPPORTING A CARTRIDGE AND A PROTECTION COVER FOR PROTECTING A PHOTOSENSITIVE DRUM OF THE CARTRIDGE

(71) Applicant: CANON KABUSHIKI KAISHA, Tokyo (JP)

(72) Inventor: Go Katsumata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/859,984

(22) Filed: Jan. 2, 2018

(65) Prior Publication Data

US 2018/0120764 A1 May 3, 2018

Related U.S. Application Data

(62) Division of application No. 15/001,323, filed on Jan. 20, 2016, now Pat. No. 9,886,001.

(30) Foreign Application Priority Data

Jan. 24, 2015 (JP) ..... 2015-011873

(51) Int. Cl.
*G03G 21/18* (2006.01)

(52) U.S. Cl.
CPC ..... *G03G 21/1832* (2013.01); *G03G 21/1817* (2013.01); *G03G 21/185* (2013.01)

(58) Field of Classification Search
CPC ..... G03G 21/1832
USPC ..... 399/114
See application file for complete search history.

(56) References Cited

U.S. PATENT DOCUMENTS

| | | | | |
|---|---|---|---|---|
| 6,256,470 | B1 * | 7/2001 | Taniyama | G03G 15/0868 222/DIG. 1 |
| 7,532,841 | B2 | 5/2009 | Tanaka | |
| 8,254,806 | B2 | 8/2012 | Kato | |
| 9,950,883 | B2 * | 4/2018 | Hirahara | B65H 1/04 |
| 2007/0206972 | A1 | 9/2007 | Tanaka | |
| 2008/0138110 | A1 | 6/2008 | Yoshino et al. | |
| 2010/0061760 | A1 | 3/2010 | Kato | |

(Continued)

FOREIGN PATENT DOCUMENTS

| | | |
|---|---|---|
| CN | 101034277 A | 9/2007 |
| CN | 101393416 A | 3/2009 |
| CN | 102128108 A | 7/2011 |

(Continued)

OTHER PUBLICATIONS

Office Action in Chinese Patent Application No. 201610034548.7, dated Mar. 28, 2019 (with English translation).

(Continued)

*Primary Examiner* — Quana Grainger
(74) *Attorney, Agent, or Firm* — Venable LLP

(57) ABSTRACT

A cartridge includes a cartridge main body, a protection member, a rib of the cartridge main body, and a pair of guides of the protection member, wherein an upstream-side guide of the guides can guide the rib when the cartridge main body is inserted into a device main body, and terminates the guide after allowing the cartridge main body to be inserted up to a position where the cartridge main body becomes independent of the device main body.

8 Claims, 16 Drawing Sheets

(56) References Cited

U.S. PATENT DOCUMENTS

| | | | |
|---|---|---|---|
| 2011/0142491 | A1 | 6/2011 | Numata et al. |
| 2016/0216687 | A1 | 7/2016 | Katsumata |

FOREIGN PATENT DOCUMENTS

| | | | |
|---|---|---|---|
| CN | 202257053 | U | 5/2012 |
| JP | 2011-083958 | A | 7/2001 |
| JP | 2004-170556 | A | 6/2004 |
| JP | 2007-240661 | A | 9/2007 |
| JP | 4983050 | B2 | 7/2012 |
| JP | 6399939 | B2 | 10/2018 |

OTHER PUBLICATIONS

Office Action in Japanese Patent Application No. 2018-164139, dated Jun. 18, 2019.
Notice of Allowance in Chinese Patent Application 201610034548.7, dated Aug. 29, 2019.

* cited by examiner

CARTRIDGE UNIT HAVING A PLURALITY OF SUPPORTING PORTIONS FOR SUPPORTING A CARTRIDGE AND A PROTECTION COVER FOR PROTECTING A PHOTOSENSITIVE DRUM OF THE CARTRIDGE

BACKGROUND OF THE INVENTION

Field of the Invention

The present invention relates to a cartridge detachably attachable to a device main body, and an image forming apparatus to which the cartridge is attached/detached.

Description of the Related Art

In image forming apparatuses of Japanese Patent Laid-Open No. 2007-240661, there is one in which a protection member can be positioned to a device main body, the protection member cannot be pulled out of the device main body during mount of the cartridge, and an engaging portion of the protection member is cancelled after mount of the cartridge and the protection member can be removed. This system can prevent the protection member from falling during insertion of the cartridge.

Further, this system employs a configuration in which a guide rail (support portion) is provided in the protection member, and a rib of the process cartridge is moved on the guide rail. Therefore, the protection member serves as a guide at the time of insertion of the process cartridge, and also prevents the falling.

Meanwhile, downsizing and space saving are desired for the process cartridge and the protection member in terms of downsizing a device main body and distribution of the process cartridge. Further, if the protection member is increased in size, the material is increased. Therefore, the downsizing of the protection member is advantageous to environmental issues.

However, if a configuration in which a central portion of the guide rail in a longitudinal direction is disconnected is produced in order to decrease sliding resistance caused when the process cartridge is moved along the guide rail of the protection member, the following problem may be caused. That is, when a configuration of a protection member having a U-shape like FIG. 2 of the present application is further applied in terms of downsizing and space saving of the cartridge, the protection member has no bottom surface and thus falls, and the process cartridge may not be able to be used.

SUMMARY OF THE INVENTION

It is desirable to provide a cartridge that can be suppressed from falling off a protection member at the time of insertion of the cartridge.

It is further desirable to provide a process cartridge detachably attachable to an image forming apparatus having a configuration below. The process cartridge includes: a cartridge including an image bearing member; a protection member detachably and attachably provided by being slid to the cartridge, and adapted to cover the image bearing member; a lock portion adapted to lock the protection member to be moved to the cartridge; an upstream-side rib and a downstream-side rib respectively provided at an upstream side and a downstream side of the cartridge in an inserting direction into which the cartridge is inserted into the image forming apparatus; a first support portion provided in the protection member, and adapted to support the upstream-side rib when the protection member is locked to the cartridge main body, to support the upstream-side rib in an area where the cartridge is inserted into a predetermined position of the image forming apparatus when the cartridge is inserted into the image forming apparatus, and not to support the upstream-side rib in an area where the cartridge is further inserted from the predetermined position of the image forming apparatus; and a second support portion provided in the protection member, and adapted to support the downstream-side rib when the protection member is locked to the cartridge main body.

Further features of the present invention will become apparent from the following description of exemplary embodiments with reference to the attached drawings.

BRIEF DESCRIPTION OF THE DRAWINGS

FIG. 11B is a perspective view illustrating a state in which the cartridge presses down a lock cancellation member.

DESCRIPTION OF THE EMBODIMENTS

Hereinafter, embodiments for implementing the present invention will be exemplarily described in detail with reference to the drawings. Note that dimensions, materials, shapes, relative positions, and the like of configuration components described in the embodiments are appropriately changed according to a configuration of a device to which the invention is applied and various conditions. Therefore, it is not intended to limit the scope of the invention to the embodiments unless otherwise especially stated.

Figure 1:
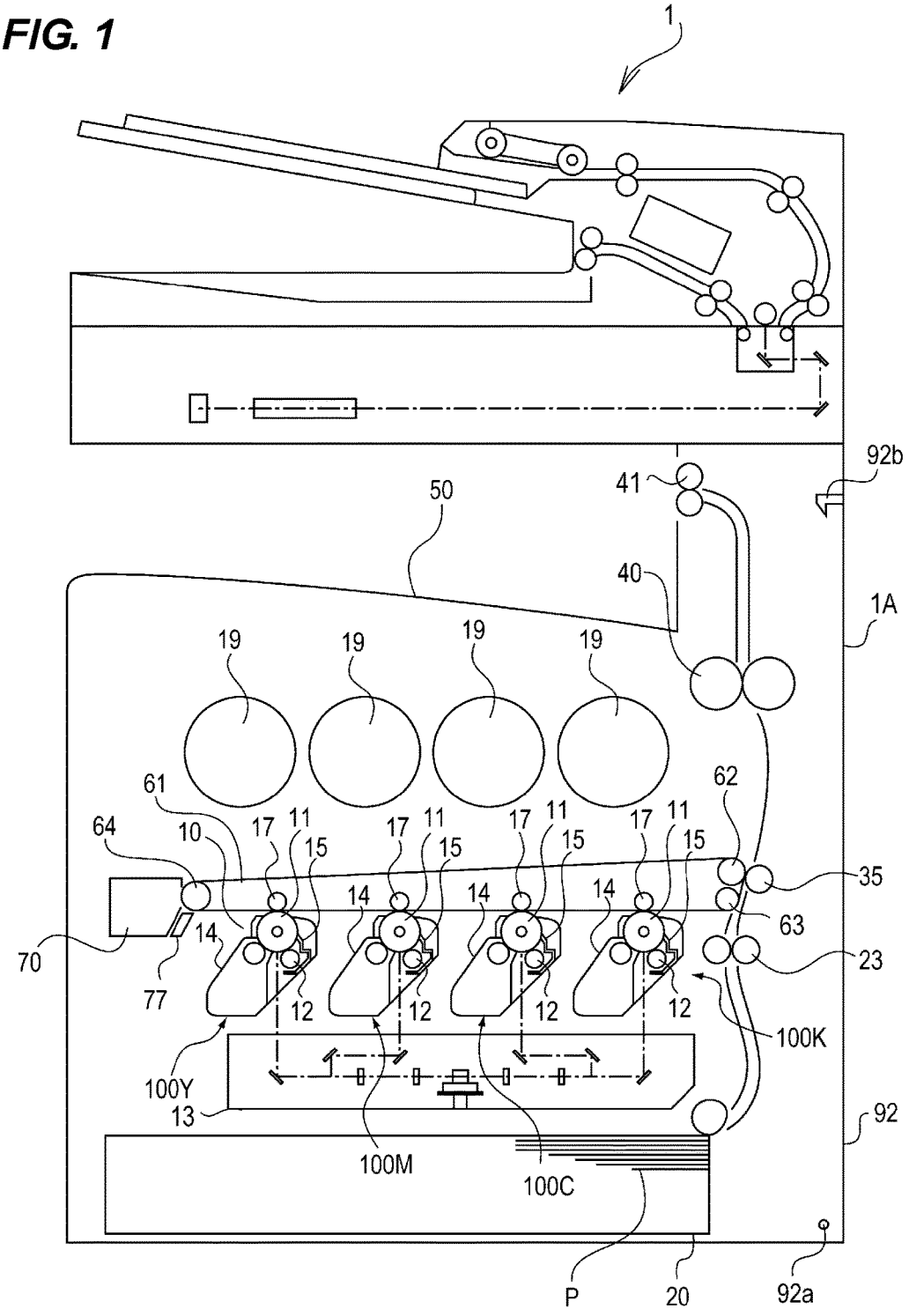
FIG. 1 is a sectional view illustrating a configuration of an image forming apparatus according to an embodiment of the present invention.

FIG. 1 is a sectional view illustrating a configuration of an image forming apparatus 1 according to an embodiment of the present invention. Here, examples of the image forming apparatus include an electrophotography copying machine, an electrophotography printer (for example, an LED printer or a laser beam printer), and an electrophotography facsimile device.

The image forming apparatus 1 includes a device main body 1A. Image forming portions 10 of respective colors of Y (yellow), M (magenta), C (cyan), and K (black) are arrange inside the device main body 1A. The image forming portion 10 includes a photosensitive drum 11. A charging roller 12, a laser scanner 13, a development device 14, a cleaning blade 15, and a primary transfer roller 17 are included around the photosensitive drum 11. An intermediate transfer belt 61 is arranged above the photosensitive drum 11. The intermediate transfer belt 61 is suspended around a drive roller 62 and rollers 63 and 64.

A surface of the photosensitive drum 11 is uniformly changed by the charging roller 12, and an electrostatic image is formed by the laser scanner 13 and is developed by the development device 14 with toner, so that a toner image is formed. The primary transfer roller 17 transfers the toner images on the surfaces of the four photosensitive drums 11 to the intermediate transfer belt 61. A small amount of residual toner remaining on the surfaces of the photosensitive drums 11 is removed by the cleaning blade 15, and again stands by for the next image formation. A toner cartridge 19 is arranged above the intermediate transfer belt 61, and supplies the toner to the development device 14.

Meanwhile, sheets P are fed to the cassette 20 one by one, and are conveyed to a pair of registration rollers 23. A tip of the sheet P is formed into a loop to follow a nip portion of the pair of registration rollers 23, so that skew feeding is corrected. Following that, the pair of registration rollers 23 conveys the sheet P between the intermediate transfer belt 61 and a secondary transfer outer roller 35 in synchronization with the toner image on the intermediate transfer belt 61. The color toner image on the intermediate transfer belt 61 is applied predetermine welding force and electrostatic load bias in a nip portion of the drive roller 62 and the secondary transfer outer roller 35, which are arranged to face each other, thereby to be transferred to the sheet P.

A small amount of residual toner remaining on the surface of the intermediate transfer belt 61 is removed and collected by a cleaning cartridge 70 having a cleaning blade 77, and again stands by for the next image formation. The toner image transferred on the sheet P is fixed by a fixing device 40 by being heated and pressurized, and the sheet P is discharged onto a discharge tray 50 by a pair of discharge rollers 41.

(Drum Cartridge)

Figure 2A:
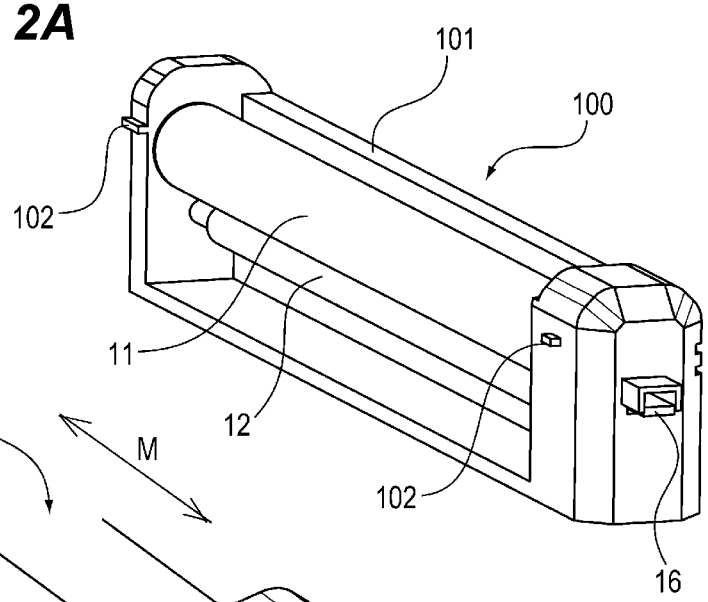
FIG. 2A is a perspective view of a cartridge, as viewed from a side of a rib.
Figure 2B:
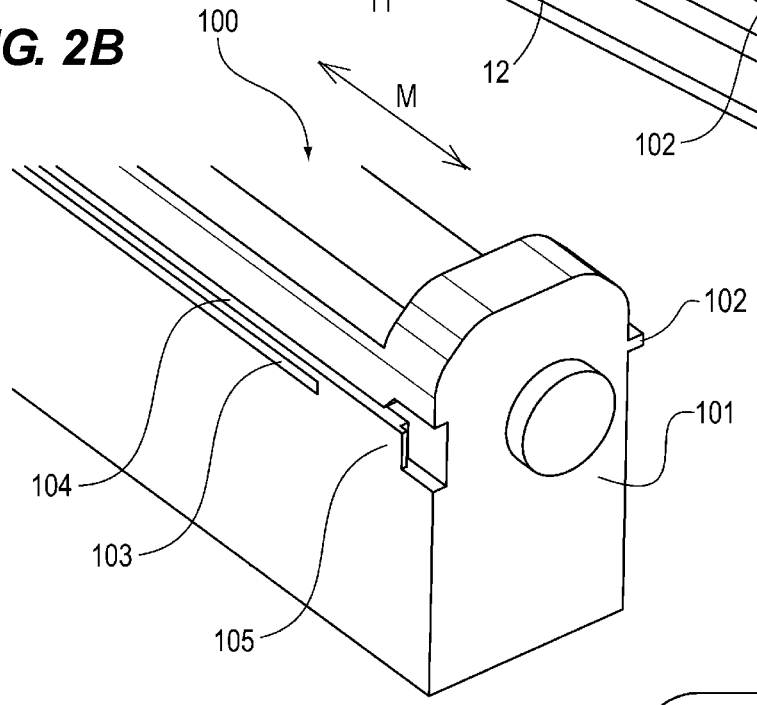
FIG. 2B is a perspective view of the cartridge, as viewed from a side of a guide.
Figure 2C:
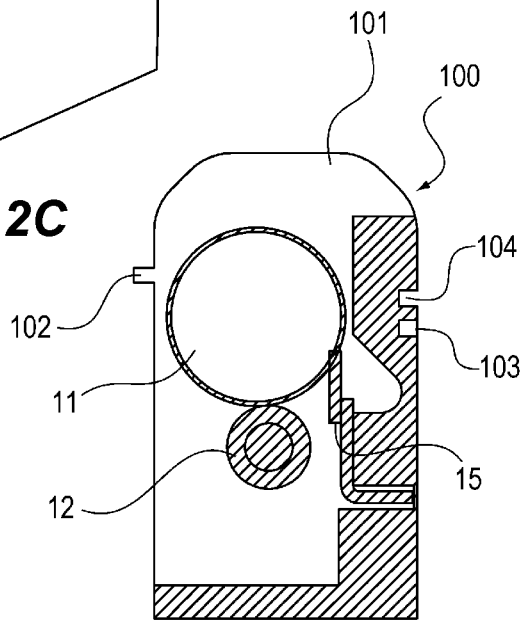
FIG. 2C is a sectional view of the cartridge.

FIG. 2A is a perspective view of a cartridge main body 100, as viewed from a side of a rib 102. FIG. 2B is a perspective view of the cartridge main body 100, as viewed from a side of a guide 103. FIG. 2C is a sectional view of the cartridge main body 100. The cartridge main body 100 is detachably attachable to the device main body 1A. The cartridge main body 100 includes a housing 101.

The housing 101 includes and integrally supports the photosensitive drum 11 as the image forming portion 10 as an "image forming unit", the charging roller 12, and the cleaning blade 15. The photosensitive drum 11 and the charging roller 12 are rotatably supported with respect to the housing 101. The charging roller 12 and the cleaning blade 15 are supported in a state of being pressurized against the photosensitive drum 11.

The photosensitive drum 11 is connected to a drive source (not illustrated) of the device main body 1A and is rotated. The charging roller 12 is rotated, following the photosensitive drum 11, because the charging roller 12 is pressurized against the photosensitive drum 11. The photosensitive drum 11, the charging roller 12, and the cleaning blade 15 become deteriorated when image formation is performed. Therefore, the cartridge main body 100 needs to be replaced according to a print amount.

Further, a guide 104 that guides a rotation phase of a lock member 230 (lock portion) (see FIG. 3) provided in a protection member 200 is provided in the cartridge main body 100. A detailed operation regarding lock will be described in a procedure of replacing the cartridge main body 100.

Therefore, the cartridge main body 100 can be inserted into a depth direction of the device main body 1A and can be taken out to a front direction. A lock cancellation member 16 that is operated when the cartridge main body 100 is extracted from the device main body 1A is provided in the cartridge main body 100 to partially protrude from the cartridge main body 100.

The rib 102 guided to a guide 212 of a base body 210 of the protection member 200 at the time of insertion, and the guide 103 for guiding a rib 213 of the base body 210 of the protection member 200 are provided in the cartridge main body 100. The ribs 102 are a pair of ribs, and are respectively provided in the cartridge main body 100 at an upstream side and a downstream side in an inserting direction of the cartridge main body 100. The ribs 102, the guide 103, and the guide 104 extend in a direction along an attaching/detecting direction M of the cartridge main body 100. Further, the image forming portion 10 is guided to the device main body 1A by the ribs 102 and the guide 103.

Further, the guide 104 that guides the rotation phase of the lock member 230 of the protection member 200 is provided in the cartridge main body 100. An operation of the lock cancellation member 16 related to an operation at the time of insertion/extraction of the cartridge main body 100 and a detailed operation related to the lock member 230 will be described in the procedure of replacing the cartridge main body 100.

(Drum Cartridge Protection Member)

Figure 3A:
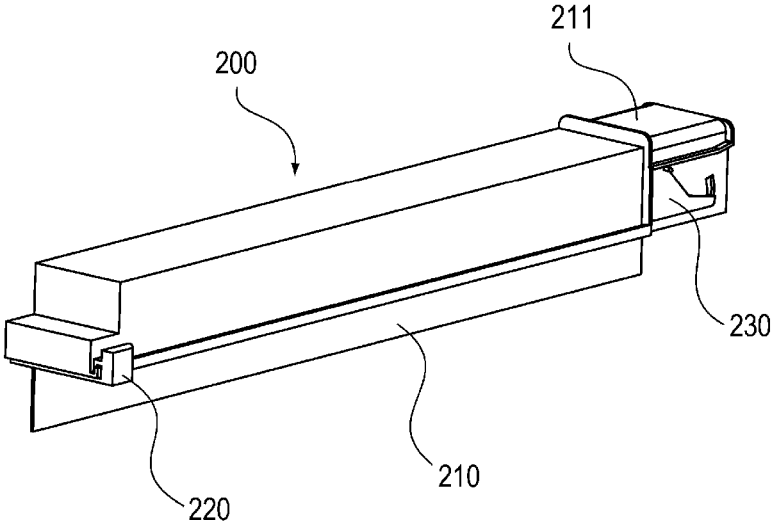
FIGS. 3A and 3B are perspective view of a protection member.
Figure 3B:
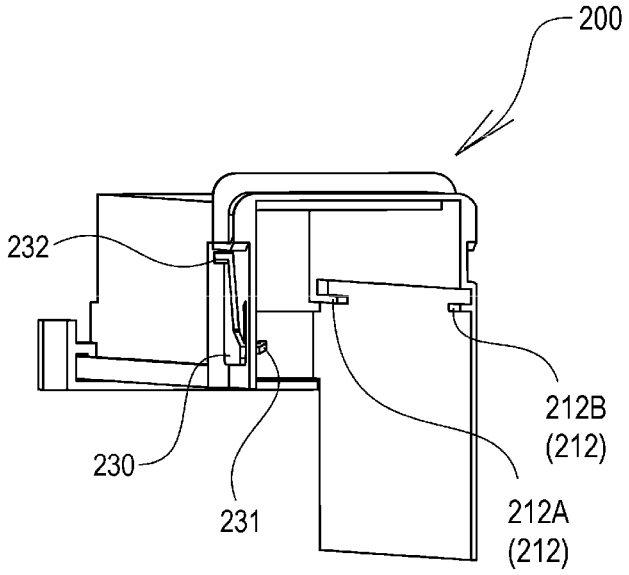
Figure 4A:
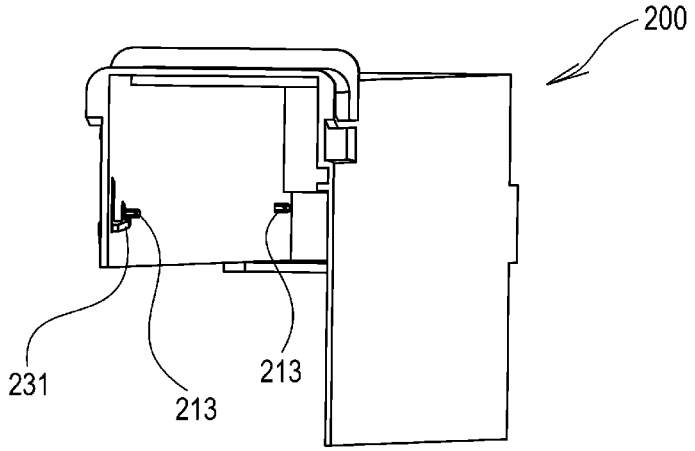
FIGS. 4A to 4C are perspective view of the protection member.

FIGS. 3A and 3B and FIG. 4A are perspective views of the protection member 200. The protection member 200 protects the image forming portion 10. The protection member 200 is detachably and attachably provided to the cartridge main body 100, has one end open in a cross section perpendicular to the attaching/detaching direction, and covers at least a part of a surface of the cartridge main body 100 except a lower surface portion of the cartridge main body 100.

The protection member 200 includes the base body 210 having an approximately U-shape in the cross section perpendicular to the attaching/detaching direction, a pushing-out member 220 independently attached to the base body 210, and the lock member 230. The protection member 200 includes an insertion portion 211 inserted into the device main body 1A. The protection member 200 includes the guide 212 and the rib 213 that support the cartridge main body 100 and guide the cartridge main body 100 when the cartridge main body 100 is inserted into the device main body 1A, inside the base body 210. The rib 102 of the cartridge main body 100 passes through the guide 212.

The guide 212 includes guides 212A and 212B as "a pair of support portions". The guide 212 is provided in the protection member 200, and supports the pair of ribs 102 when the protection member 200 is locked to the cartridge main body 100.

Figure 4B:
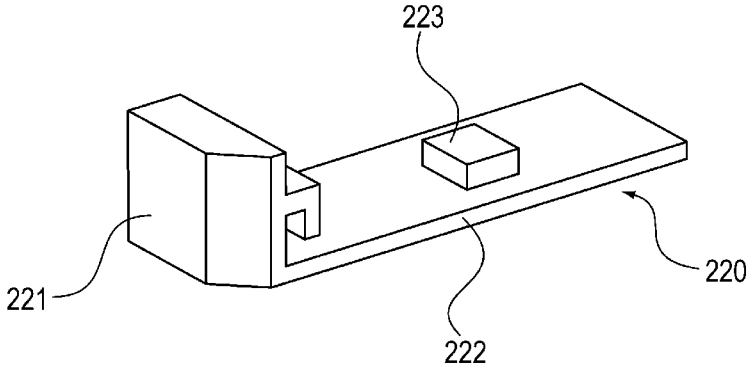

Further, the pushing-out member 220 is independently attached to the base body 210. As illustrated in FIG. 4B, the pushing-out member 220 includes an operation portion 221, a pushing-out surface 222, and an engaging portion 223. At the time of replacement of the cartridge main body 100, an operator moves the operation portion 221 in the inserting direction of the cartridge main body 100, thereby to move the cartridge main body 100 while the pushing-out surface 222 is in contact with the cartridge main body 100. The engaging portion 223 will be described in detail in the procedure of replacing the cartridge main body 100 described below.

Figure 4C:
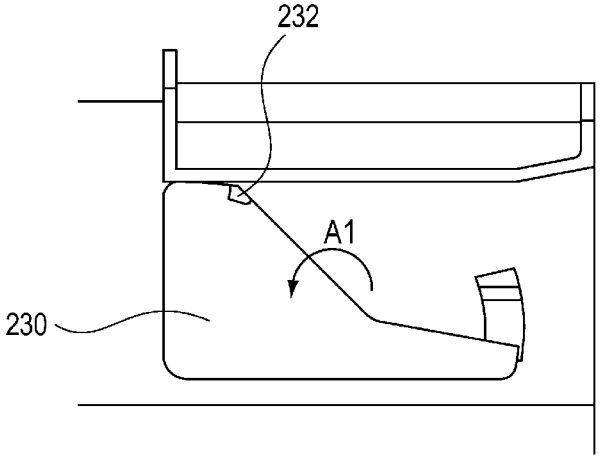

Further, the lock member 230 is independently attached to the base body 210. The lock member 230 includes a cartridge lock portion 231 for locking the cartridge main body 100 and the base body 210 and a cover lock portion 232 for locking the protection member 200 and the device main body 1A. As illustrated in FIG. 4C, the lock member 230 is rotatably held to the base body 210 in a direction of an arrow A1.

(Protection State of Drum Cartridge)

Figure 5A:
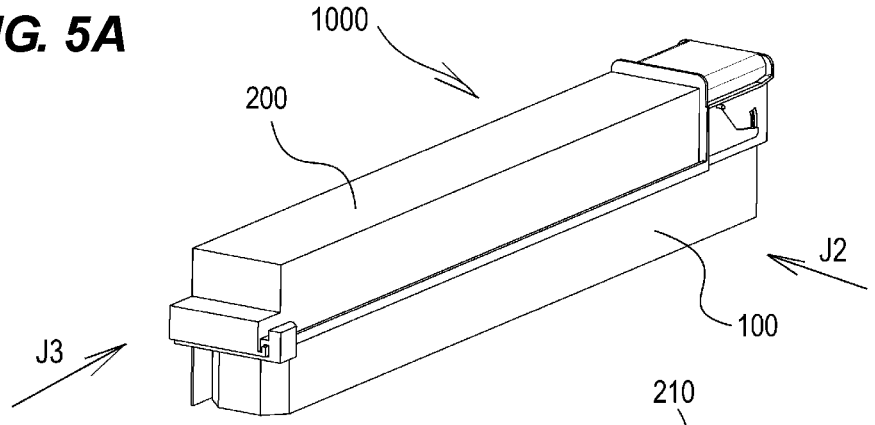
FIG. 5A is a perspective view of a state where the cartridge is protected by the protection member.
Figure 5B:
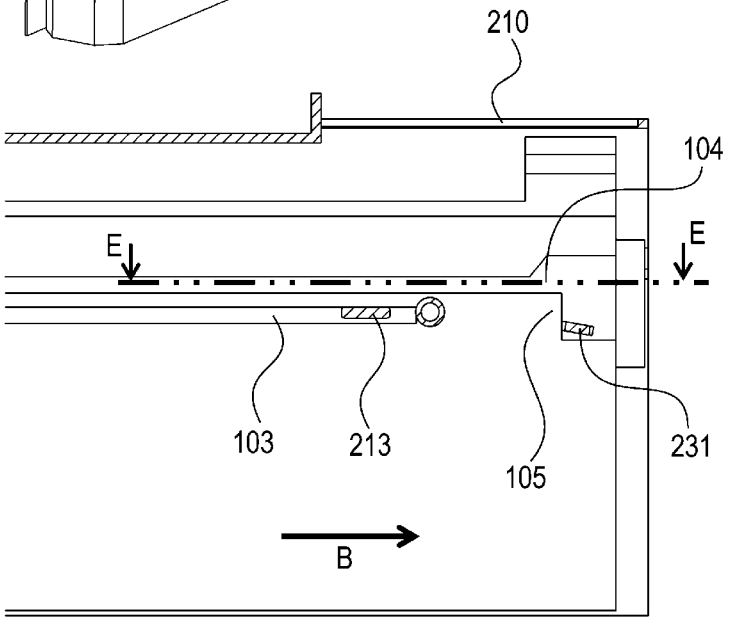
FIG. 5B is a sectional view of a state where the cartridge is protected by the protection member, as viewed from a direction of an arrow J2 of FIG. 5A.
Figure 5C:
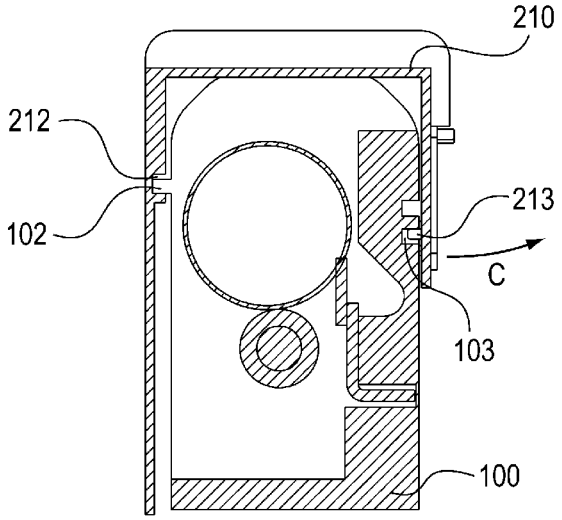
FIG. 5C is a sectional view of a state where the cartridge is protected by the protection member, as viewed from a direction of an arrow J3 of FIG. 5A.
Figure 6A:
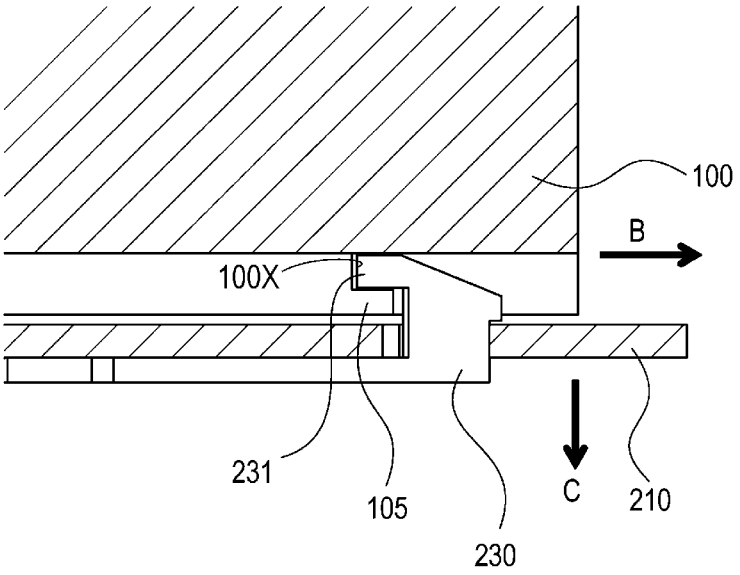
FIG. 6A is a sectional view of a vicinity of a lock member, as viewed from a direction of an arrow E of FIG. 5B.

FIG. 5A is a perspective view of a state in which the cartridge main body 100 is protected by the protection member 200. FIG. 5B is a sectional view of a state in which the cartridge main body 100 is protected by the protection member 200, as viewed from a direction of an arrow J2 of FIG. 5A. FIG. 5C is a sectional view of a state in which the cartridge main body 100 is protected by the protection member 200, as viewed from a direction of an arrow J3 of FIG. 5A. FIG. 6A is a sectional view of a vicinity of the lock member 230, as viewed from a direction of an arrow E of FIG. 5B. Here, a cartridge 1000 includes the cartridge main body 100 and the protection member 200.

The protection member 200 covers and protects the cartridge main body 100, thereby to protect the photosensitive drum 11, the charging roller 12, and the cleaning blade 15 housed in the image forming portion 10. The guide 212 of the protection member 200 and the rib 102 of the cartridge main body 100 are engaged with each other. The rib 213 of the protection member 200 and the guide 103 of the cartridge main body 100 are engaged with each other.

When the cartridge main body 100 is protected by the protection member 200, the lock member 230 exists in the position illustrated in FIGS. 5B and 6A, and the cartridge lock portion 231 of the lock member 230 is engaged with a recessed portion 100X (lock portion) of the cartridge main body 100. Therefore, the lock member 230 locks the cartridge main body 100 not to be slid in a direction of an arrow B relative to the protection member 200. At the same time, the protection member 200 is suppressed to be opened in a direction of an arrow C by the cartridge lock portion 231 of the lock member 230 and an opening-prevention rib 105 of the cartridge main body 100.

When the base body 210 has an approximately U-shape, as illustrated in FIG. 3, the shape is vulnerable to deformation in the direction of the arrow C. If the base body 210 is deformed in the direction of the arrow C, the lock member 230 attached to the base body 210 is also moved in the direction of the arrow C, following the deformation of the base body 210.

Figure 6B:
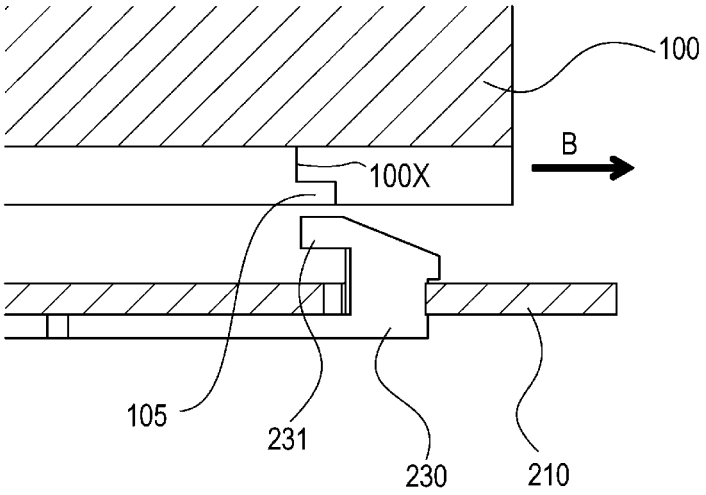
FIG. 6B is a sectional view of a vicinity of the lock member of when a base body and the cartridge are separated, as viewed from the direction of the arrow E of FIG. 5B.

FIG. 6B is a sectional view of a vicinity of the lock member 230 of when the base body 210 and the cartridge main body 100 are separated, as viewed from the direction of the arrow E of FIG. 5B. In the position where the lock member 230 illustrated in FIG. 6B has moved in the direction of the arrow C by a fixed amount, the cartridge lock portion 231 of the lock member 230 cannot regulate the movement of the cartridge main body 100 in the direction of the arrow B. As a result, the cartridge main body 100 can be moved in the direction of the arrow B (a direction of being dropped out from the protection member 200), and falls off the protection member 200.

The opening-prevention rib 105 and the cartridge lock portion 231 are engaged with each other, so that the cartridge main body 100 can be prevented from falling off the protection member 200 due to the deformation of the base body 210.

(Procedure of Replacing Drum Cartridge)

Figure 7A:
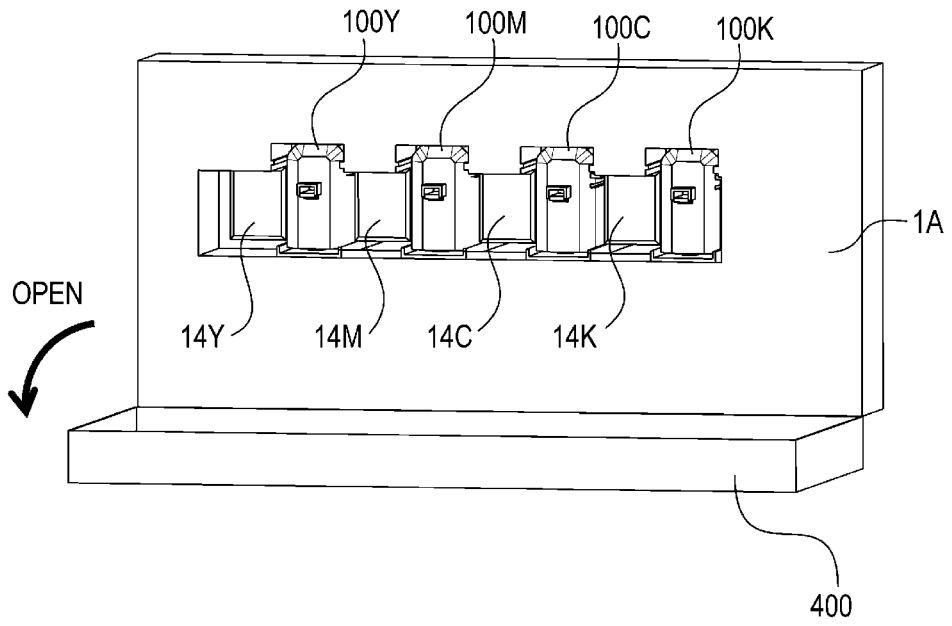
FIGS. 7A and 7B are perspective view illustrating a process in which the cartridge is attached to/detached from a device main body.

Next, a procedure of replacing a drum cartridge (a cartridge main body 100C of cyan) using the protection member 200 of the present invention will be described. The procedure of replacing the cartridge main body 100 will be described by reference to FIGS. 7 to 16. The device main body 1A provides a sign of replacement of the cartridge main body 100C of cyan. A user opens a front cover 400 (FIG. 7A). The front cover 400 is provided in front of the device main body 1A, and is turned to open/close. When releasing the front cover 400, the user can access the cartridge main body 100 of the device main body 1A.

Figure 7B:
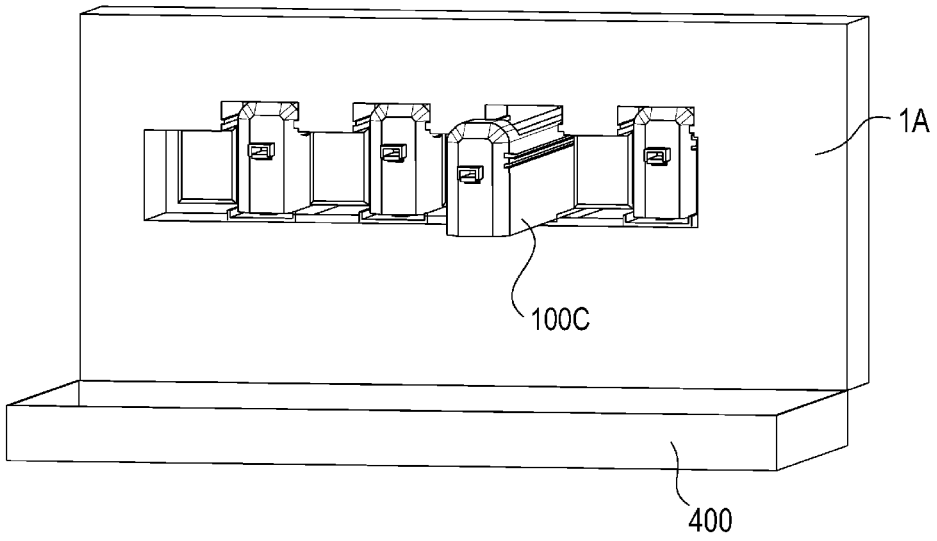
Figure 10A:
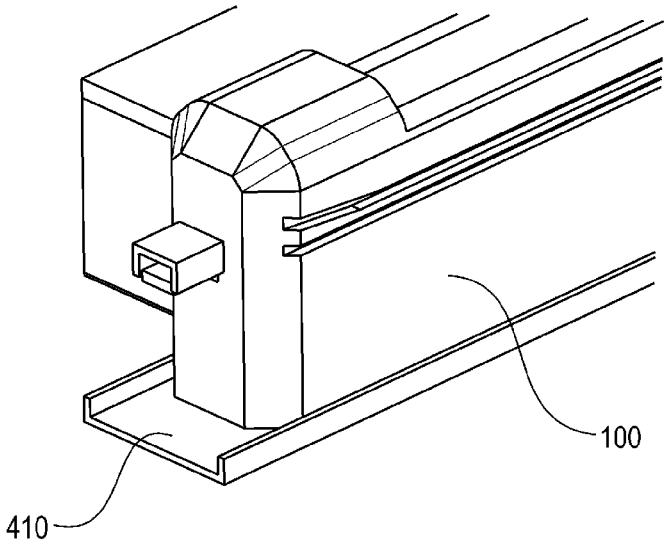
FIGS. 10A and 10B are perspective view illustrating the cartridge and a cartridge rail.
Figure 10B:
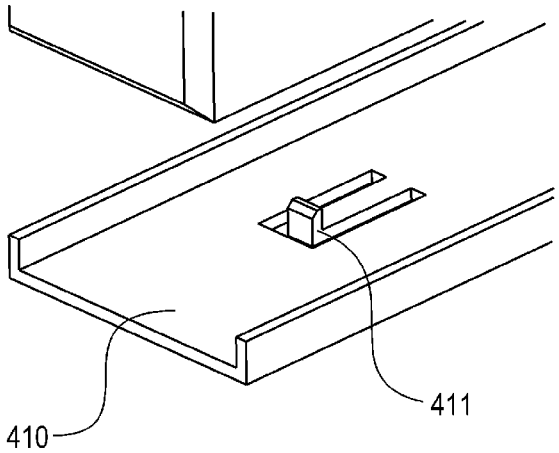

The lock of the cartridge main body 100C is cancelled, and the cartridge main body 100C is pulled out (FIG. 7B). As illustrated in FIG. 10, the cartridge main body 100C is locked to the front of the device main body 1A (a direction of an arrow F) not to be dropped out with a hooking projection 411 provided in the cartridge rail 410.

Figure 11A:
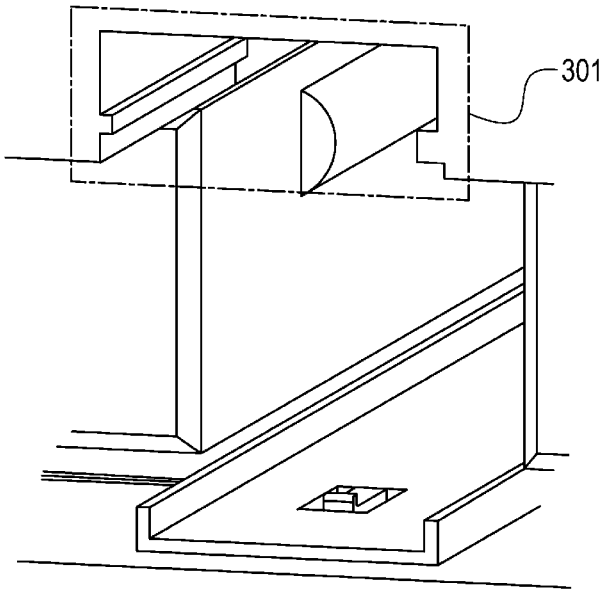
FIGS. 11A and 11B are perspective view illustrating a configuration of a portion to be mounted.
Figure 11B:
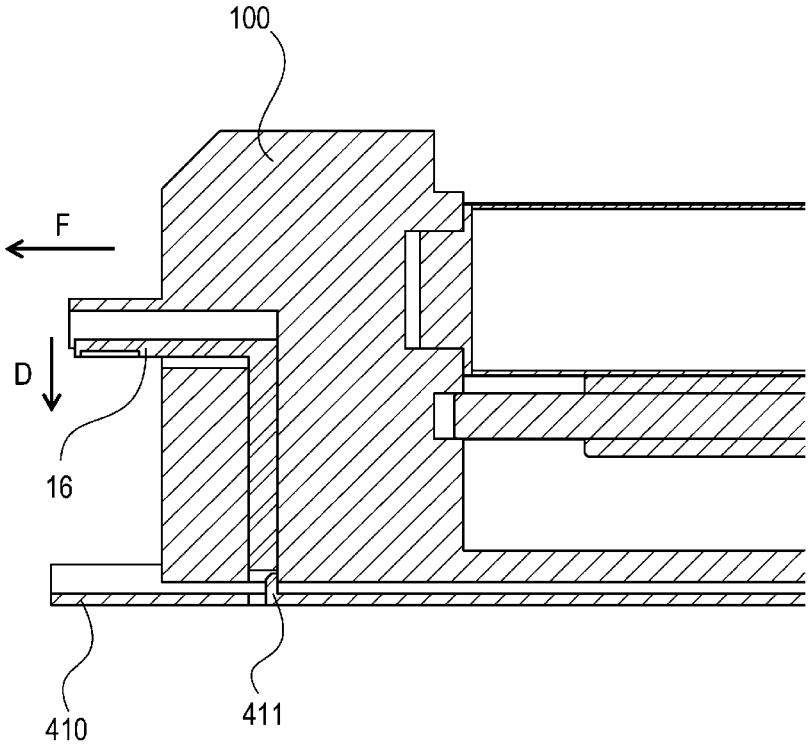

As illustrated in FIG. 11B, when the lock cancellation member 16 provided in the cartridge main body 100C is pressed down in a direction of an arrow D, and the hooking projection 411 formed in a cartridge rail 410 is pressed down to cancel the lock of the cartridge main body 100C, the cartridge main body 100C can be pulled out of the device main body 1A in the direction of the arrow F. After the cartridge main body 100C is pulled out, the cartridge main body 100C has already been used, and thus protection after pulled out may be more roughly performed than at the time of insertion because it is not a problem even if an exposure portion is damaged. The cartridge main body 100C after pulled out is collected by a service person or the like.

Figure 8A:
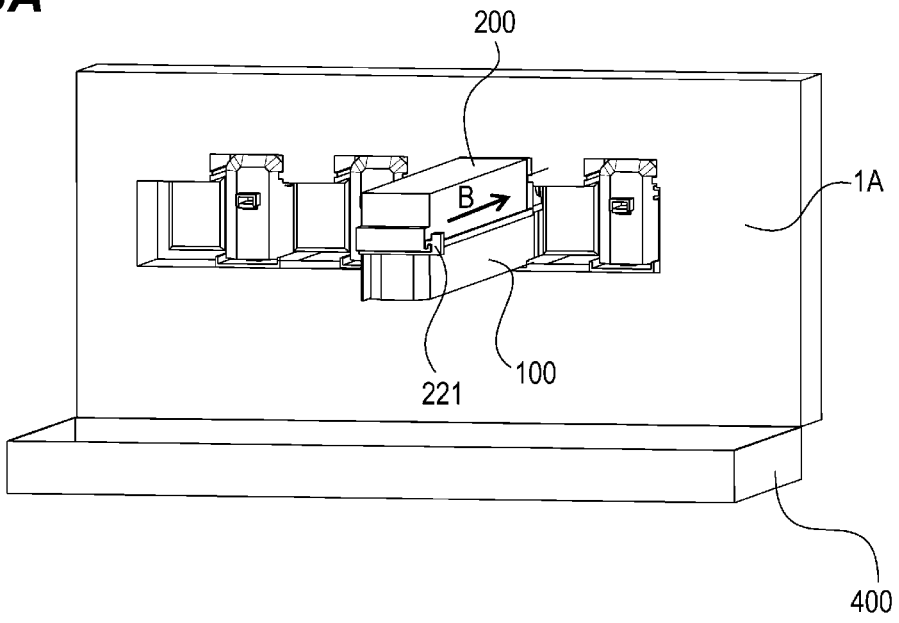
FIGS. 8A and 8B are perspective view illustrating a process in which the cartridge is attached to/detached from the device main body.

An insertion portion 201 of the protection member 200 is inserted into a portion to be inserted 301 of the device main body 1A in a state where the cartridge main body 100C is protected by the protection member 200 (FIGS. 8A and 11A).

Figure 12A:
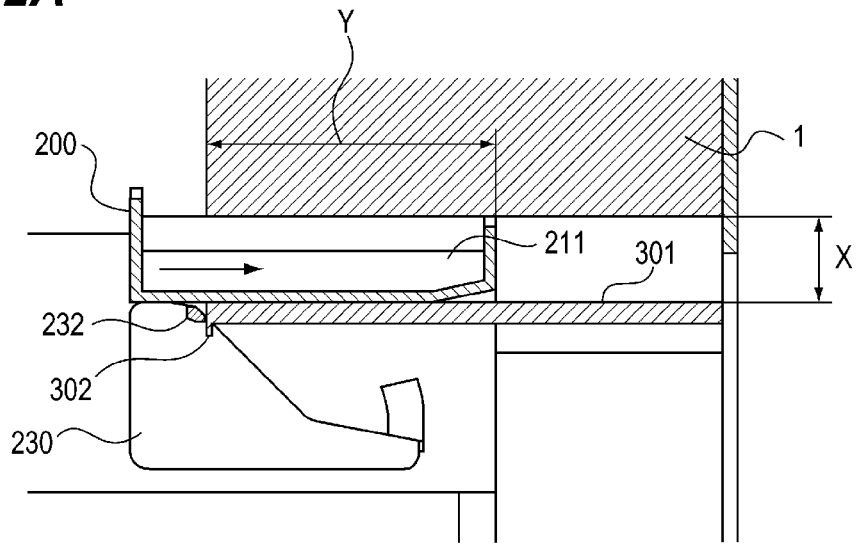
FIGS. 12A and 12B are diagrams illustrating an operation of the lock member.

FIG. 12A is a side view of the protection member 200. As illustrated in FIG. 12A, the insertion portion 201 of the protection member 200 and the portion to be inserted 301 of the device main body 1A have small rattling in an engagement width X. Therefore, when an insertion amount y becomes large to some extent, the protection member 200 does not fall even if the hand of the user is separated from the protection member 200.

When the insertion portion 201 of the protection member 200 is inserted and pushed into the portion to be inserted 301 of the device main body 1A, the cover lock portion 232 of the lock member 230 of the protection member 200 comes in contact with the cancellation lock rib 302 of the device main body 1A, and the lock member 230 is rotated in the direction of the arrow A1. The protection member 200 is further pushed, the cover lock portion 232 enters more inside of the device main body 1A than the cancellation lock rib 302 (FIGS. 12A to 13A).

Figure 12B:
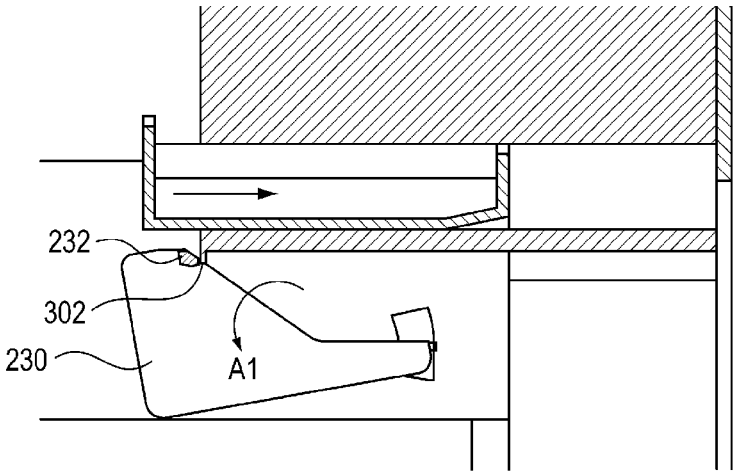
Figure 13A:
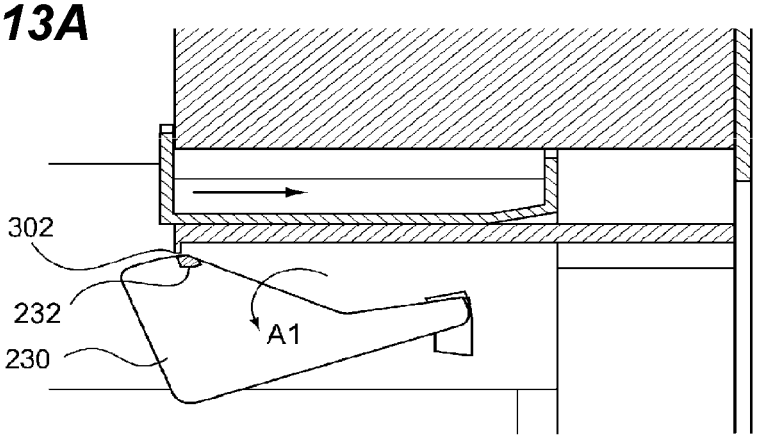
FIGS. 13A to 13C are diagrams illustrating an operation of the lock member.
Figure 14A:
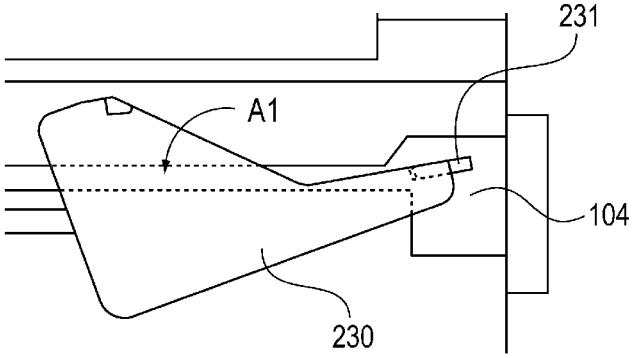
FIGS. 14A to 14C are diagrams illustrating an operation of the lock member.

At the same time, the lock member 230 is rotated in the direction of the arrow A1 and is transferred to the state of FIG. 14A, as illustrated in FIG. 12A→FIG. 12B→FIG. 13A. Then, the lock is cancelled due to the engagement of the cartridge lock portion 231 with the recessed portion 100X of the cartridge main body 100C between the protection member 200 and the cartridge main body 100C. The cartridge main body 100C can then be slid in the direction of the arrow B.

Figure 8B:
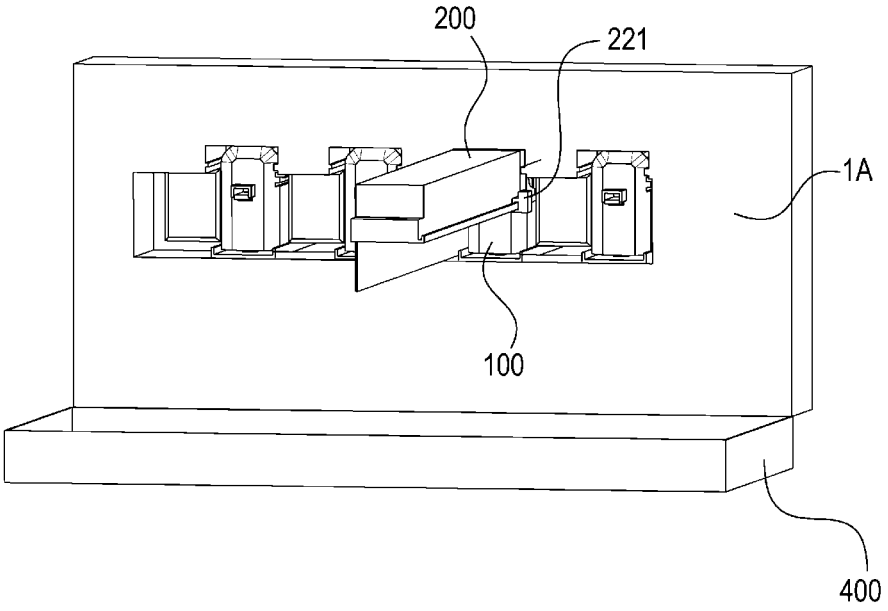

When the pushing-out member 220 of the protection member 200 is operated in the direction of the arrow B, the cartridge main body 100C is pushed out by the pushing-out surface 222 of the pushing-out member, and only the cartridge main body 100C is inserted into the device main body 1A while the protection member 200 remains on site (FIGS. 8A and 8B).

At this time, the rib 102 of the cartridge main body 100C and the guide 212 of the base body 210, the guide 103 of the cartridge main body 100 and the rib 213 of the base body 210 are respectively engaged with each other, so that the cartridge main body 100C is protected by the protection member 200. When the cartridge main body 100C is moved in the direction of the arrow B, the cartridge main body 100C passes on the rib 102 and the guide 212. At this time, if the guide 212 exists in the entire inserting direction (R1+R2+R3 of FIG. 15A), sliding resistance at the time of insertion of the cartridge main body 100 is always applied during the insertion, and operability is deteriorated.

Further, if a guide exists near the center in the longitudinal direction (R2 of FIG. 15A), the guide and the surface of the photosensitive drum 11 are in contact with each other when the base body 210 is deformed, and the photosensitive drum 11 may be damaged. Therefore, limiting an area where the guide 212 exists (R1 and R3 of FIG. 15A) is effective for operability and safety of replacement of the cartridge main body 100.

A minimum area necessary for the guide 212 is a position where the guide 212 supports the rib 102 in a state where the cartridge main body 100C is protected by the protection member 200. In a protection state, movement of the cartridge main body 100C in the direction of the arrow B is regulated by the lock member 230. Therefore, even if the guide 212 is provided to be limited to the area where the guide 212 supports the rib 102, the cartridge main body 100C does not fall off the protection member 200 at the time of distribution of the cartridge main body 100. Therefore, the guide 212 is formed such that a section in the middle of the attaching/detaching direction of the cartridge main body 100 is disconnected in the position where the protection member 200 can support the rib 102.

However, if the area where the guide 212 is provided is too narrow, the cartridge main body 100C may fall off the protection member 200 in a state where the insertion amount of the cartridge main body 100C to the device main body 1A is small. Meanwhile, if the cartridge main body 100C is inserted into the device main body 1A by a fixed amount, the cartridge main body 100C can be independent of the device main body 1A. Therefore, the guide 212 for supporting the rib 102 is provided up to a position where the cartridge main body 100C can be independent of the device main body 1A (R1 of FIG. 15A).

That is, a guide 212A as a taking-out direction-side portion, as a "portion at a side in a taking-out direction of the cartridge main body 100" of the guide 212 is not disconnected up to a distance where the cartridge main body 100 becomes independent of the device main body 1A. In doing so, the cartridge main body 100C can be prevented from falling off the device main body at the time of replacement. Note that the guide 212B arranged at the downstream side in the inserting direction of the cartridge has a guiding function in the present embodiment. However, the guide 212B may not necessarily have the guiding function as long as the guide 212B can support the rib 102 at least before insertion of the cartridge.

The guide 212A as an "upstream support portion" arranged at an upstream side in the inserting direction of the cartridge main body 100, of the pair of guides 212, can guide the rib 102 when the cartridge main body 100 is inserted into the device main body 1A, and terminates the guide of the rib 102 after allowing the cartridge main body 100 to be inserted up to the position where the cartridge main body 100 becomes independent of the device main body 1A. The guide 212A terminates the guide of the rib 102 before the cartridge main body 100 is half or more inserted into the device main body 1A.

Figure 15A:
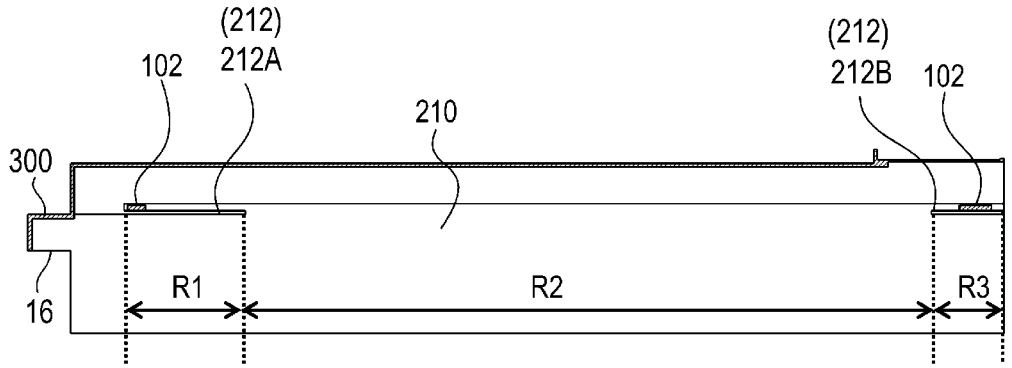
FIG. 15A is a sectional view illustrating the guide of the protection member and the rib of the cartridge.
Figure 15B:
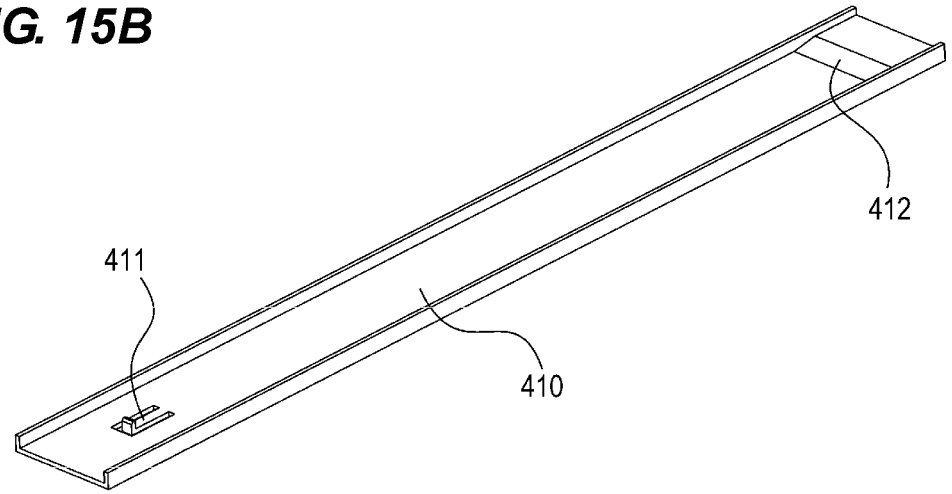
FIGS. 15B and 15C are perspective views of a cartridge rail.
Figure 15C:
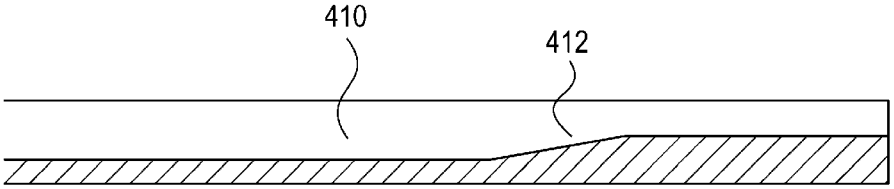

In the area where the guide 212 does not exist (R2 in FIG. 15A), the pushing-out member 220 abuts on the cartridge main body 100 at a position below the cancellation member of a protruding portion 300 on a front surface of the cartridge main body 100C (see FIG. 15A). The pushing-out member 220 includes the pushing-out surface 222 that comes in contact with the cartridge main body 100, and a part of the cartridge main body 100 exists at an upper side than an upper surface of the pushing-out member 220 in the position where the pushing-out surface 222 is in contact with the cartridge main body 100. Therefore, the pushing-out member 220 can support the cartridge main body 100 not to fall off the protection member 200. Accordingly, falling of the cartridge main body 100C during insertion can be prevented by the guide 212 and the pushing-out member 220.

The pushing-out member 220 is a member movably held to the protection member 200, and can push out the cartridge main body 100. The pushing-out member 220 can be moved in association with the movement of the cartridge main body 100 such that a part of the cartridge main body 100 is positioned above the pushing-out member 220 in the vertical direction, until the cartridge main body 100 is guided to the mount position of the device main body 1A. The pushing-out member 220 includes the engaging portion 223 that is to be engaged with the cartridge main body 100, and the engaging portion 223 is released from the cartridge main body 100 in a state where the cartridge main body 100 is mounted to the device main body 1A.

However, if an operator directly pushes out the cartridge main body 100C in the direction of the arrow B without using the pushing-out member 220, the falling of the cartridge main body 100 in the area where no guide 212 exists (R2 in FIG. 15A) cannot be prevented.

Figure 16A:
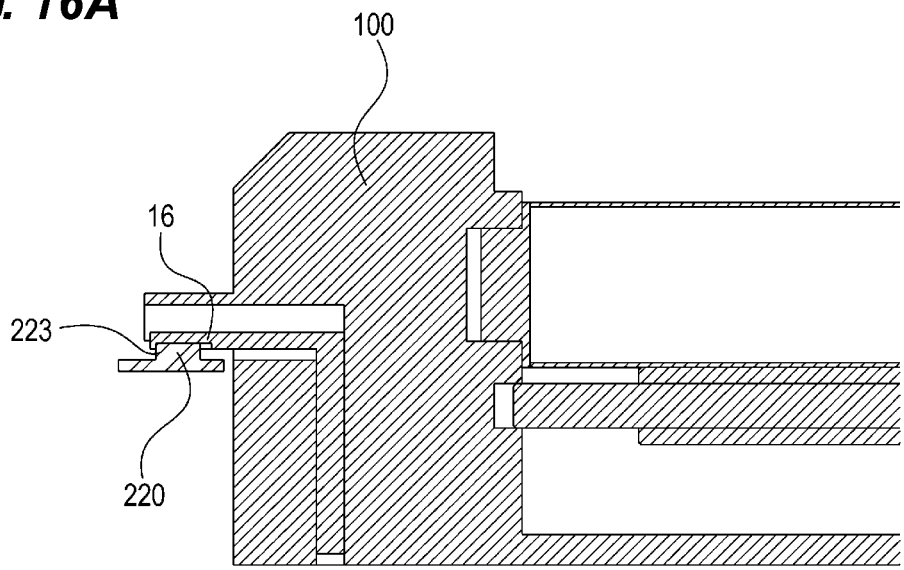
FIGS. 16A and 16B are sectional view illustrating a pressing member and the cartridge.
Figure 16B:
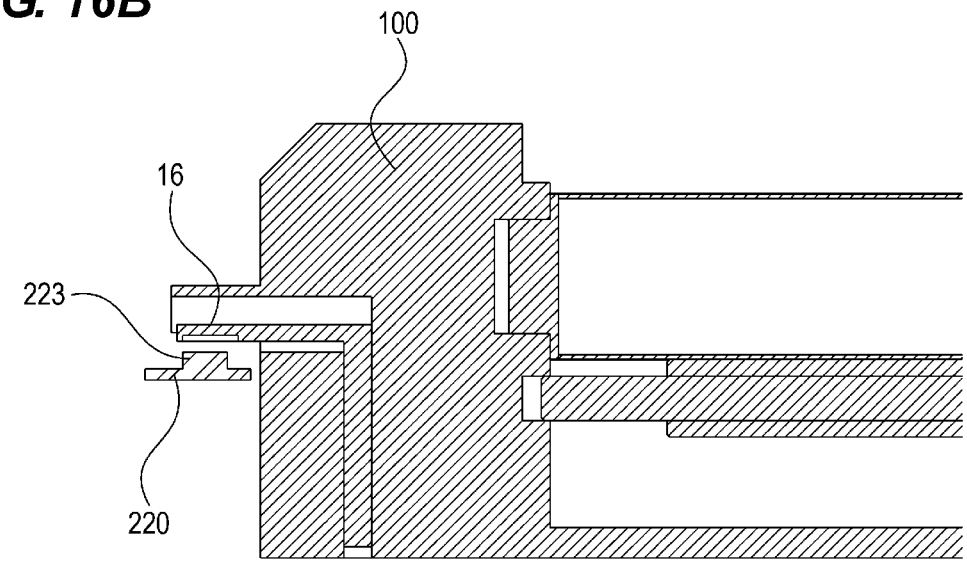

At this time, as illustrated in FIG. 16B, the engaging portion 223 of the pushing-out member 220 is engaged with the lock cancellation member 16 of the cartridge main body 100, so that the pushing-out member 220 is moved in the direction of the arrow B, following the movement of the cartridge main body 100C, and the falling in the area where no guide 212 exists can be prevented. With the above configuration, even if the operator performs a wrong operation, replacement work of the cartridge main body 100 can be safely performed.

Figure 14B:
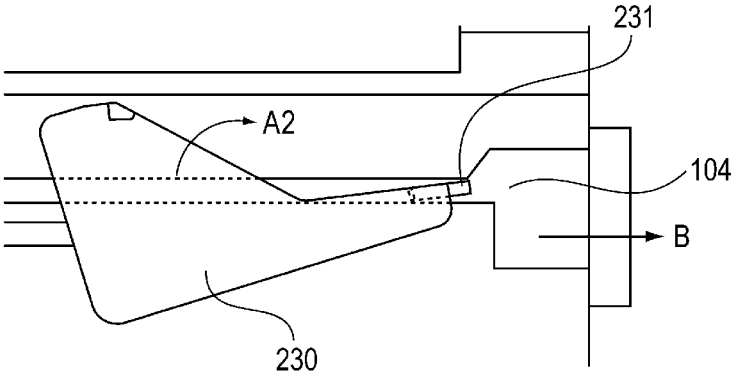
Figure 14C:
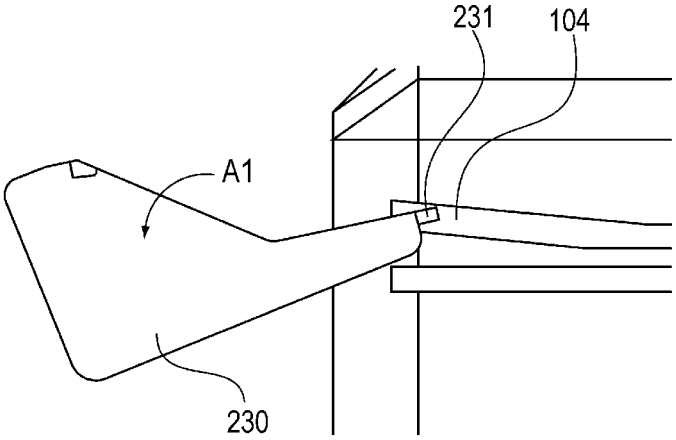

Further, a detailed operation of the lock member 230 at this time will be described. The cartridge lock portion 231 of the lock member 230 is guided by the guide 104 of the cartridge main body 100C in the direction of the arrow A2, as illustrated in FIG. 14B.

Figure 13B:
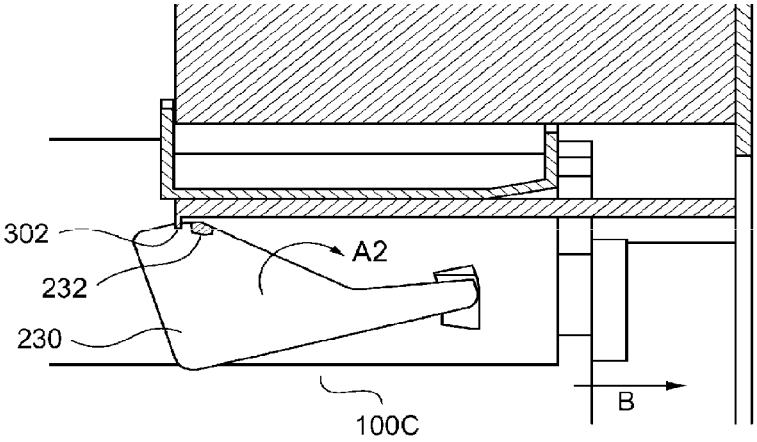

When the lock member 230 is rotated in the direction of the arrow A2, as illustrated in FIG. 13B, the cover lock portion 232 goes around behind the cancellation lock rib 302 of the device main body 1A.

In this state, when the protection member 200 is pulled out of the device main body 1A, the cartridge lock portion 231 of the lock member 230 is guided by the guide 103 of the cartridge main body 100C. Therefore, the lock member 230 cannot be rotated, and the cover lock portion 233 is caught by the cancellation lock rib 302 of the device main body 1A, and the protection member 200 cannot be pulled out.

If the protection member 200 can be pulled out in a state where the cartridge main body 100C is slightly pushed out, and the protection member 200 is pulled out, the cartridge main body 100C is in an unstable state to the protection member 200 and to the device main body 1A, and thus falls. This can be avoided by providing the lock mechanism of the protection member 200.

Further, the lock of the device main body 1A and the protection member 200 is performed in conjunction with normal work of pushing out of the cartridge main body 100C. Therefore, it is not necessary to increase an operation to lock the device main body 1A and the protection member 200.

When the cartridge main body 100C is pushed deep, as illustrated in FIG. 8B, an inclined portion 412 (see FIGS. 15B and 15C) is provided in the cartridge rail 410 at the downstream side in the inserting direction of the cartridge main body 100, and thus the cartridge main body 100C can be raised in a height direction along the inclined portion 412 at the end of the insertion. With this displacement, the engaging portion 223 of the pushing-out member 220 and the cartridge main body 100C are disengaged, as illustrated in FIG. 16B. Therefore, the engaging portion 223 is released from the cartridge main body 100 in the state where the cartridge main body 100 is mounted to the device main body 1A.

Figure 13C:
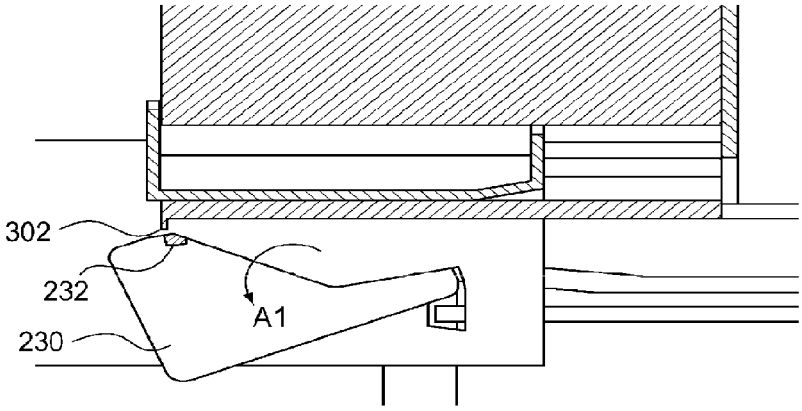

Further, when the cartridge main body 100C is pushed deep, the cartridge lock portion 231 of the lock member 230 is guided by the guide 104, and the lock member 230 is rotated in the direction of the arrow A1 again, as illustrated in FIG. 13A. The cover lock portion 232 does not overlap with the cancellation lock rib 302 in the pulling out direction. Therefore, the protection member 200 can be removable state (FIG. 13C). The lock cancellation of the device main body 1A and the protection member 200 is also performed in conjunction with a normal operation, similarly to the lock. Therefore, it is not necessary to increase an operation.

Further, when the lock is cancelled, the cartridge main body 100C is independent of the device main body 1A because the device main body 1A and the protection member 200 are engaged in a state where the engagement rattling is small. Therefore, the protection member 200 cannot fall after completion of the insertion of the cartridge main body 100C.

Figure 9A:
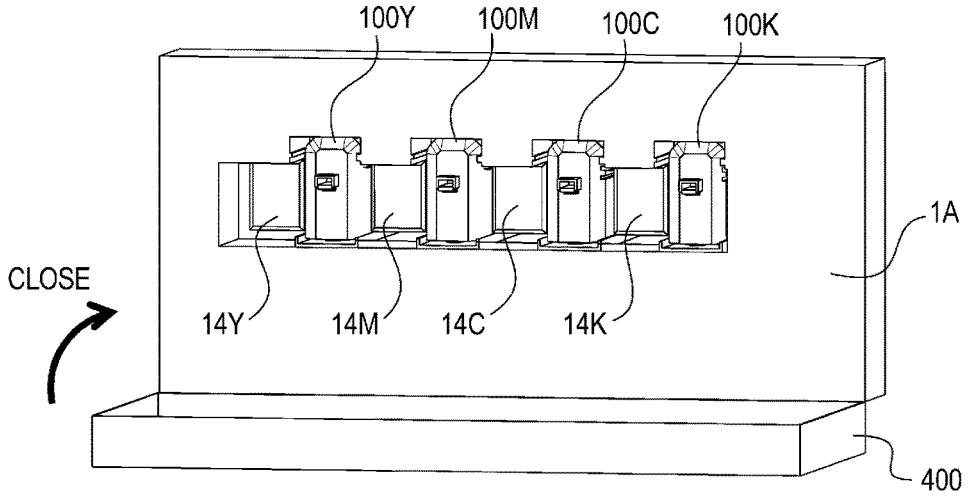
FIGS. 9A and 9B are perspective view illustrating a process in which the cartridge is attached to/detached from the device main body.
Figure 9B:
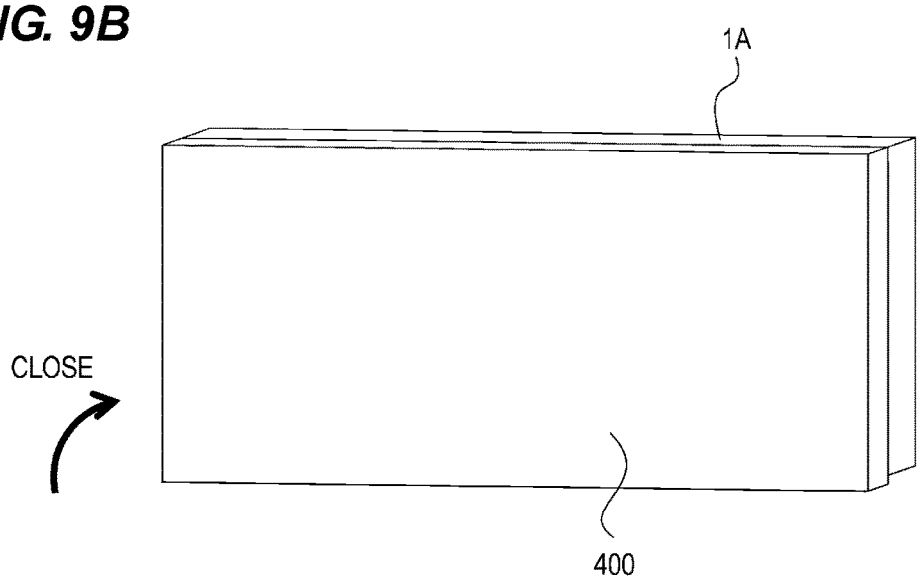

The protection member 200 is removed (FIG. 9A). The cover lock portion 232 comes free from the cancellation lock rib 302, as illustrated in FIG. 12B. Therefore, the protection member 200 can be removed from the device main body 1A. The front cover 400 is closed (see FIG. 9B) (completion).

In the present embodiment, an example of replacing the cyan cartridge main body 100C has been described. However, replacement is similarly performed for other cartridge main bodies 100.

Further, in the present embodiment, an example of the cartridge main body 100 has been described. However, an embodiment is not limited to the example. Anything can be employed as long as the one includes an image forming unit such as a charging cartridge having only a charging function, a cleaner cartridge having only a function of a cleaner, a transfer cartridge having a transfer function, or a fixing cartridge having a fixing function.

An example of moving the cartridge main body 100, using the inclined portion 412 provided in the cartridge main body 100 of the cartridge rail 410 attached to the device main body 1A so that the engaging portion 223 of the pushing-out member 220 and the cartridge main body 100 are disengaged in the process of insertion has been described. Note that the engagement may be disengaged by movement of the cartridge main body 100 by the guide 212 of the protection member 200, or may be disengaged by movement of the pushing-out member.

As described above, the cartridge main body 100 is positioned to the device main body 1A in the state where the cartridge main body 100 is protected by the protection member 200, and then the cartridge main body 100 is inserted into the device main body 1A. In doing so, the cartridge main body 100 can be inserted into the device main body 1A without damaging the photosensitive drum 11 as the image forming portion 10, the charging roller 12, and the cleaning blade 15.

According to the present invention, when the cartridge main body 100 is inserted into the device main body 1A, falling of the cartridge main body 100 is prevented by the guide 212 of the protection member 200 until the cartridge main body 100 is inserted up to the position where the cartridge main body 100 can be independent of the device main body 1A. Falling of the cartridge main body 100 is prevented by the pushing-out member 220 while the guide 212 is disconnected, so that falling of the cartridge main body during insertion can be prevented.

Further, by limiting the area where the guide 212 is provided, the sliding resistance at the time of insertion of the cartridge main body 100 can be reduced, and the cartridge main body 100 can be replaced with light operation force. Further, the guide 212 is not provided in the central portion in the longitudinal direction, which is easily deformed. Therefore, the contact between the guide 212 and the surface of the photosensitive drum 11 can be prevented.

Further, by engaging the pushing-out member 220 and the cartridge main body 100, falling of the pushing-out member 220 can be prevented even if the operator wrongly pushes out the cartridge main body 100 in a direct manner.

As a result, downsizing of the protection member 200 can be realized while operability and safety of replacement work of the cartridge main body 100 can be maintained.

According to the present invention, in the configuration in which the protection member protects the cartridge and the center of the support portion provided in the protection member is disconnected, the cartridge can be prevented from falling off the protection member at the time of insertion of the cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-011873, filed Jan. 24, 2015, which is hereby incorporated by reference herein in its entirety.

What is claimed is:

1. A cartridge unit comprising:

a cartridge configured to be attached to an image forming apparatus main body having a cartridge guide for guiding movement of the cartridge, the cartridge comprising:

a photosensitive drum; and a housing configured to support the photosensitive drum rotatably, wherein the cartridge is configured to be attached to the image forming apparatus main body by sliding movement in a direction of a rotary axis of the photosensitive drum; and a protection cover configured to protect a photosensitive surface of the photosensitive drum and configured to support the housing before being attached to the image forming apparatus main body, the protection cover (i) being temporally attached to the image forming apparatus main body to guide attachment of the cartridge in a process of attaching the cartridge to the image forming apparatus main body, and (ii) being detached from the image forming apparatus body after supporting the attachment of the cartridge, the protection cover comprising:

a frame including a protecting portion that covers the photosensitive surface, with a lower portion of the frame in a vertical direction being open in a state in which the protection cover is attached to the image forming apparatus main body;

a first supporting portion and a second supporting portion projecting from a face of the frame and facing a side of the cartridge so as to support the cartridge before the cartridge is attached to the image forming apparatus main body, the first supporting portion and the second supporting portion being disposed at different positions in the direction of the rotary axis; and a pushing-out portion disposed on the frame so that the pushing-out portion moves by sliding in the direction of the rotary axis so as to push the cartridge to move toward the image forming apparatus main body during the attaching process, with the pushing-out portion supporting the cartridge, wherein the cartridge is removed from the support by the first supporting portion and the second supporting portion in a state in which the pushing-out portion slides to move the cartridge, with the cartridge thereby being attached to the image forming apparatus main body and the cartridge being supported by the pushing-out portion and the cartridge guide.

2. The cartridge unit according to claim 1, wherein the frame has U-shape in a cross-section in a vertical direction through the rotary axis.

3. The cartridge unit according to claim 1, further comprising a lock mechanism configured to lock the protection cover to the image forming apparatus main body, wherein the lock mechanism comprises a lock portion configured to lock the protection cover to the image forming apparatus main body when the cartridge is inserted by the pushing-out portion.

4. The cartridge unit according to claim 1, wherein the pushing-out portion is configured to push the cartridge at an upstream side in a sliding direction of the cartridge during the attaching process.

5. A cartridge unit comprising:

a cartridge configured to be attached to an image forming apparatus main body having a cartridge guide for guiding movement of the cartridge, the cartridge comprising:

a photosensitive drum;

a housing configured to support the photosensitive drum rotatably, wherein the cartridge is configured to be attached to the image forming apparatus main body by sliding movement in a direction of a rotary axis of the photosensitive drum; and a protection cover configured to protect a photosensitive surface of the photosensitive drum and configured to support the housing before being attached to the image forming apparatus main body, the protection cover (i) being temporally attached to the image forming apparatus main body to guide attachment of the cartridge in a process of attaching the cartridge to the image forming apparatus main body, and (ii) being detached from the image forming apparatus body after supporting the attachment of the cartridge, the protection cover comprising:

a frame including a protecting portion that covers the photosensitive surface, with a lower portion of the frame in a vertical direction being open in a state in which, the protection cover is attached to the image forming apparatus main body;

a first supporting portion, a second supporting portion, a third supporting portion, and a fourth supporting portion projecting from a face of the frame and facing to a side of the cartridge so as to support the cartridge before the cartridge is attached to the image forming apparatus main body, the first supporting portion and the second supporting portion being disposed at different positions in the direction of the rotary axis, the third supporting portion and the fourth supporting portion being disposed at different positions in the direction of the rotary axis, and the first supporting portion and the second supporting portion being disposed at an opposite side of the cartridge from the third supporting portion and the fourth supporting portion in a horizontal direction; and a pushing-out portion disposed on the frame so that the pushing-out portion moves by sliding in the direction of the rotary axis so as to push the cartridge to move toward the image forming apparatus main body during the attaching process, with the pushing-out portion supporting the cartridge, wherein the cartridge is removed from support by the first supporting portion, the second supporting portion, third supporting portion, and the fourth supporting portion in a state in which the pushing-out portion slides to move the cartridge, with the cartridge thereby being attached to the image forming apparatus main body and the cartridge being supported by the pushing-out portion and the cartridge guide.

6. The cartridge unit according to claim 5, wherein the frame has U-shape in a cross-section in a vertical direction through the rotary axis.

7. The cartridge unit according to claim 5, further comprising a lock mechanism configured to lock the protection cover to the image forming apparatus main body, wherein the lock mechanism comprises a lock portion configured to lock the protection cover to the image forming apparatus main body when the cartridge is inserted by the pushing-out portion.

8. The cartridge unit according to claim 5, wherein the pushing-out portion is configured to push the cartridge at an upstream side in a sliding direction of the cartridge during the attaching process.

* * * * *